US006234214B1

(12) United States Patent
Tominaga

(10) Patent No.: US 6,234,214 B1
(45) Date of Patent: May 22, 2001

(54) METHOD FOR HANDLING SEMICONDUCTOR WAFERS IN A CLEAN ROOM BY WEARING DUST PROOF CLOTHING

(75) Inventor: Yukihiro Tominaga, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/481,494

(22) Filed: Jan. 12, 2000

Related U.S. Application Data

(62) Division of application No. 09/153,360, filed on Sep. 15, 1998, now Pat. No. 6,034,007.

(30) Foreign Application Priority Data

Apr. 21, 1998 (JP) ..... 9-110620

(51) Int. Cl.[7] ..... F24F 7/06; A41D 13/00; A41D 27/00

(52) U.S. Cl. ..... 139/383 R; 139/420 A; 2/901; 442/208

(58) Field of Search ..... 2/901; 139/383 R, 139/420 A; 442/208

(56) References Cited

U.S. PATENT DOCUMENTS 5,883,022 * 3/1999 Elsener ..... 442/192
5,981,409 * 11/1999 Takagi et al. ..... 442/203
5,991,921 * 11/1999 Saito ..... 2/69
6,034,007 * 3/2000 Tominaga ..... 442/208

FOREIGN PATENT DOCUMENTS 1-239172 9/1989 (JP) .
3-26535 2/1991 (JP) .
7-238470 9/1995 (JP) .

* cited by examiner

*Primary Examiner*—Andy Falik
(74) *Attorney, Agent, or Firm*—Jones Volentine, LLC

(57) ABSTRACT

Dust proof clothing is made of a given fabric structure defined by multiple first fiber groups which are each composed of linear fibers and extend in a first direction, and multiple second fiber groups which are each composed of curved fibers and extend in a second direction intersecting the first direction. The first and second fiber groups are mutually interwoven such that an inside surface has more of the second fiber groups exposed than the first fiber groups, and such that an outside surface which is opposite said inside surface has more of the first fiber groups exposed than said second fiber groups. The dust proof clothing is worn such that the inside surface is in contact with a wearer of the dust proof clothing.

6 Claims, 4 Drawing Sheets

METHOD FOR HANDLING SEMICONDUCTOR WAFERS IN A CLEAN ROOM BY WEARING DUST PROOF CLOTHING

This application is a division of Ser. No. 09/153,360 filed Sep. 15, 1998 now U.S. Pat. No. 6,034,007.

BACKGROUND OF THE INVENTION

1. Field of the Invention

The present invention relates to the construction of dust proof clothing worn in clean rooms especially in the clean rooms of the semiconductor field, sealed equipment field, medical and pharmaceutical field and food processing fields, etc., where it is necessary to control various dust from a product quality and hygiene perspective.

2. Description of the Related Art

At present, clean rooms are used in various fields. Normally, people engaged in operations in these clean rooms perform their operations wearing special work clothing called dust proof clothing in order to maintain the degree of cleanliness within the room. In recent years, the demand for the level of cleanliness in the clean rooms has increased markedly in a variety of fields.

For example, concerning the clean room of the semiconductor field, in conjunction with the increased level of integration of semiconductor devices, a cleanliness degree equivalent to the United States standard "Class 1" is demanded. This "Class 1" indicates that no more than one particle of dust less than 0.5 $\mu$m is present in 1 cubic foot.

In order to maintain this high level of cleanliness, proposals relating to clean rooms, proposals relating to dust proof clothing, etc., have been made in various fields. For example, as a proposal relating to dust proof clothing, Japanese Laid Open Patent Gazette, Laid Open Patent Hei 3-26535 is known.

Until now, proposed dust proof clothing has not satisfied the extremely high degree of cleanliness demanded for wearing within clean rooms.

SUMMARY OF THE INVENTION

The object of the present invention is to provide an improved method for handling semiconductor wafers in a clean room, which includes wearing dust proof clothing whereby much of the dust attached to the wearer is captured within the dust proof clothing, and it is difficult for dust to adhere to the outside of the dust proof clothing, and which has superior strength.

In order to achieve this object, various embodiments of the invention are shown below.

Dust proof clothing that is worn according to the invention is comprised so that on the inside surface more curved fibers are exposed than linear fibers, and on the outside surface more linear fibers are exposed than curved fibers.

By this construction, there are only a few dust catching spaces on the outside surface compared to the inside surface, and there are a lot of dust catching spaces on the inside surface compared to the outside surface.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DESCRIPTION OF THE PREFERRED EMBODIMENT

In the following, the configuration of the preferred embodiment is described with reference to the drawings. In this case, a detailed description is given for elements directly concerning the invention.

Figure 1:
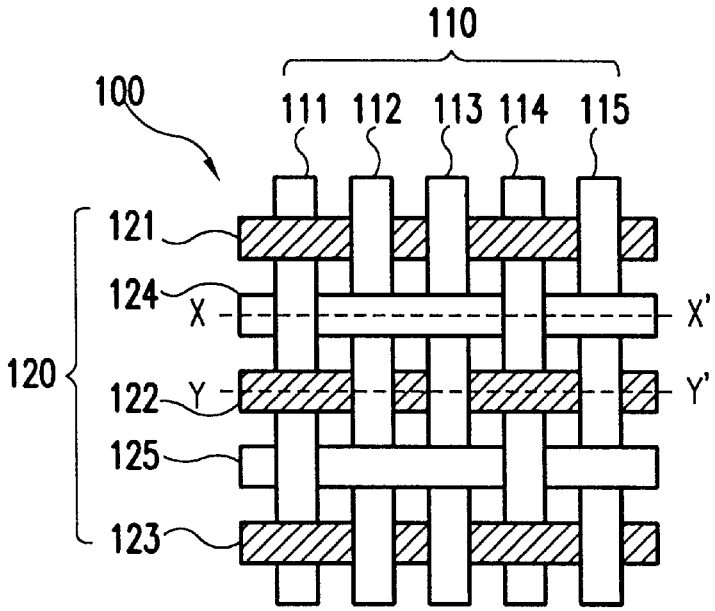
FIG. 1 is a partially enlarged plan view showing the configuration of a first embodiment of the present invention.
Figure 2:
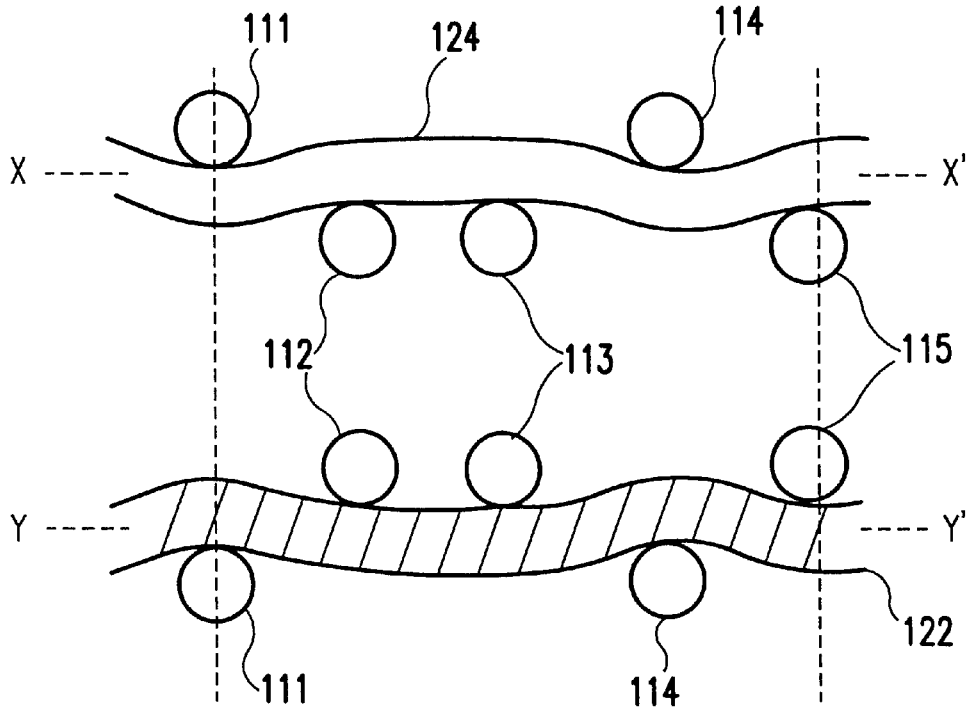
FIG. 2 is a partially enlarged sectional view showing the configuration of the first embodiment of the present invention.

FIG. 1 is a plan drawing for describing the configuration of the first embodiment, FIG. 2 is a sectional drawing for describing the configuration of the first embodiment. FIG. 2 is a sectional view of lines X–X', Y–Y' of FIG. 1. These drawings schematically represent the essential parts of the material comprising the dust proof clothing in an enlarged view. In FIG. 1, the front of the drawing is the outside of the dust proof clothing, and the rear of the drawing is the inside of the dust proof clothing. In FIG. 2, the upper direction of the drawing is the outside of the dust proof clothing, and the lower side of the drawing is the inside of the dust proof clothing. The inside of the dust proof clothing is the side coming into contact with the body of the person wearing the dust proof clothing, the outside is the opposite side, the side in contact with the surrounding atmosphere. More specifically, the inside is the inner surface (or the reverse surface), and the outside is the outer surface side of the clothing.

In the configuration of the first embodiment, material 100 of the dust proof clothing is of a construction having multiple fiber groups 110 extending in the first direction and multiple fiber groups 120 extending in the second direction intersecting the first direction mutually interwoven. In the drawings, for convenience, uniform gaps have been provided between the fiber groups, but in the actual material, it can be understood that the gaps are not necessarily uniform. Ideally the fiber groups are completely sealed, although small gaps can be considered to exist in parts. In the configuration of the present embodiment and the configuration of other embodiments, descriptions will be given referring to drawings provided with uniform gaps.

Here, the first direction means the vertical direction, and the second direction means the horizontal direction where it is substantially perpendicular with the first direction. The intersection of the fiber groups in the drawings is perpendicular, but in the actual material, as it is difficult to say that the fibers will necessarily be perpendicular, here, the definition "the first direction" and "the second direction" has been used.

Multiple fiber group 110 is comprised of fiber groups 111 through 115. Multiple fiber group 120 is comprised of fiber groups 121 through 125.

Fiber groups 111 through 115 and fiber groups 121 through 125 are each fiber groups of bundled multiple micro fibers. These fiber groups are often called thread.

Fiber groups 111 through 115 are bundled polymers of multiple linear polyester fibers each with a diameter of 15~20 μm, with each fiber group having a thickness of approximately 50~100 μm in diameter. Here, polyester fibers are used, but it is possible to use fibers of nylon or other material. Also concerning the fibers shown below, it goes without saying that other materials can be suitably selected in the same way.

Fiber groups 121 through 123 are bundled polymers of multiple curved polyester fibers each with a diameter of 5~10 μm, with each fiber group having a thickness of 50~80 μm in diameter. Here, the curved polyester represent polyester fibers processed in a wave or sinuous state.

It is desirable that the diameters of these fiber groups 121 through 123 are smaller than the diameters of the fiber groups 111 through 115. It can be assumed that the diameter of each of the fibers and fiber groups will differ according to the material, etc., but the designer will suitably select so that the duality of the vertical direction fiber groups and the lateral direction fiber groups has the above mentioned relationship.

Fiber group 124 and fiber group 125 are respectively arranged between fiber group 121 and fiber group 122, and between fiber group 122 and fiber group 123. This fiber group 124 and 125, as with the aforementioned fiber group 111 through 115, are bundled polymers of multiple linear polyester fibers each with a diameter of 15~20 μm, with each fiber group having a thickness of approximately 50~100 μm in diameter.

Next, with reference to FIG. 2 showing a cross sectional view of the line X–X', and the line Y–Y' in FIG. 1, a specific description will be given of the mutually interwoven structure of the vertical direction fiber groups and the lateral direction fiber groups.

Fiber groups 121 through 123 on the outside of the dust proof clothing extend to the inside of the dust proof clothing passing over one fiber group 111. Further, fiber groups 121 through 123 on the inside of the dust proof clothing extend to the outside passing over two fiber groups 112 and 113. Further, fiber groups 121 through 123 on the inside of the dust proof clothing extend to the outside passing over one fiber group 114.

Fiber groups 124 and 125 on the inside of the dust proof clothing extend to the outside of the dust proof clothing crossing fiber group 111. Further, fiber groups 124 and 125 on the outside of the dust proof clothing extend to the inside crossing two fiber groups 112 and 113. Further, fiber groups 121 through 123 on the inside of the dust proof clothing extend to the outside of the dust proof clothing crossing fiber group 114.

Multiple fiber group 110 and multiple fiber group 120 form material 100 of the dust proof clothing by being repeatedly interwoven in the aforementioned pattern.

As can be understood from FIG. 1 and FIG. 2, in cross section X–X' only liner fiber groups (111 through 115 and 124) are indicated.

In this case, where fiber group 124 appears on the outside and the inside of the dust proof clothing, the separation on the inside is "one (fiber group 124 extending across fiber group 111)" compared to "two (fiber group 124 extending over fiber group 112 and 113)" on the outside. In the case where fiber groups 111 through 113 appear on the outside and the inside of the dust proof clothing, the separation on the inside is "two (fiber group 112 and 113 extending over fiber group 124)" compared with "one (fiber group 111 extending over fiber group 124)" on the outside.

On the other hand, on the Y–Y' cross section linear fiber groups (111 through 115)" and curved fiber group 122 appear.

In this case, where fiber group 122 appears on the outside and the inside of the dust proof clothing, the separation on the inside is "two (fiber group 122 extending over fiber group 112 and 113)" compared to "one (fiber group 122 extending over fiber group 111)" on the outside. In the case where fiber groups 111 through 113 appear on the outside and the inside of the dust proof clothing, the separation on the inside is "one (fiber group 111 extending over fiber group 122)" compared to "two (fiber group 112 and 113 extending over fiber group 122)" on the outside.

As material 100 of the configuration of the present embodiment is a repetition of the pattern of FIG. 1 and FIG. 2, the ratio of fiber group 110 appearing on the outside to appearing on the inside of the dust proof clothing is 3 to 3, that is to say 1 to 1. Also, the ratio of curved fiber groups 121 through 123 and linear fiber groups 124 and 125 appearing on the outside of the dust proof clothing is 2 to 1, while the ratio of curved fiber groups 121 through 123 and linear fiber group 124 and 125 appearing on the inside of the dust proof clothing is 1 to 2.

Namely, the linear fiber groups are exposed more on the outside of the dust proof clothing than curved fiber groups, and curved fiber groups are exposed more on the inside of the dust proof clothing than linear fiber groups. In this embodiment, as the diameter of the linear fiber groups is larger than the curved fiber groups, it can be said that more large diameter fiber groups are exposed on the outside and more small diameter fiber groups are exposed on the inside. Also, it can be said that a lot of thick linear thread is exposed on the outside and narrow curved thread is exposed on the inside.

In the case where dust proof clothing is produced using material composed in this way, the following results can be expected.

On the inside of the dust proof clothing which comes in contact with the wearer, as more small diameter curved fibers are exposed than linear fibers, more dust (dust from the clothes worn by the wearer, dust, etc., attached to the clothes or the wearer) is caught. This is due to the dust being caught by the space parts called "fiber pockets" between each of the fibers. These fiber pockets exist between fiber and fiber and fiber group and fiber group. As fiber pockets exist in such places, more spaces are formed between curved fibers than between linear fibers. That is to say, curved fibers have more fiber pockets than linear fibers. Further, it is thought that the number of fiber pockets increases with decrease in the diameter.

Also, on the outside of the dust proof clothing, as more large diameter linear fibers are exposed on the outside than curved fibers, the probability of surrounding dust being caught is extremely low compared to curved fibers. That is to say, even if the dust proof clothing is exposed to environments with a lot of dust, these linear fibers have difficulty in incorporating the dust. Therefore, the release of dust incorporated into dust proof clothing into a clean room is prevented. This kind of dust re-release prevention is an extremely important element in the realization of a clean room with an aforementioned high degree of cleanliness. An aforementioned environment with a lot dust are such environments as the environment where the dust proof clothing is stored after the wearer has removed the dust proof clothing, or environments where the wearer wearing the dust proof clothing is showered with dust from devices, jigs or the handled material.

Further, curved fiber produces pills easier in comparison to linear fibers, and as it is easily caught on surrounding devices, by exposing more large diameter linear fibers than curved fibers on the outside of the dust proof clothing, the occurrence of catching the dust proof clothing on devices is controlled. This prevents damage to the dust proof clothing and means an improvement in the durability of the dust proof clothing.

In this way, according to the configuration of the first embodiment of the present invention, dust proof clothing can be realized wherein the release of dust from the wearer can easily be caught and outside dust is not easily caught.

Next, the configuration of the second embodiment of the present invention will be described.

Figure 3:
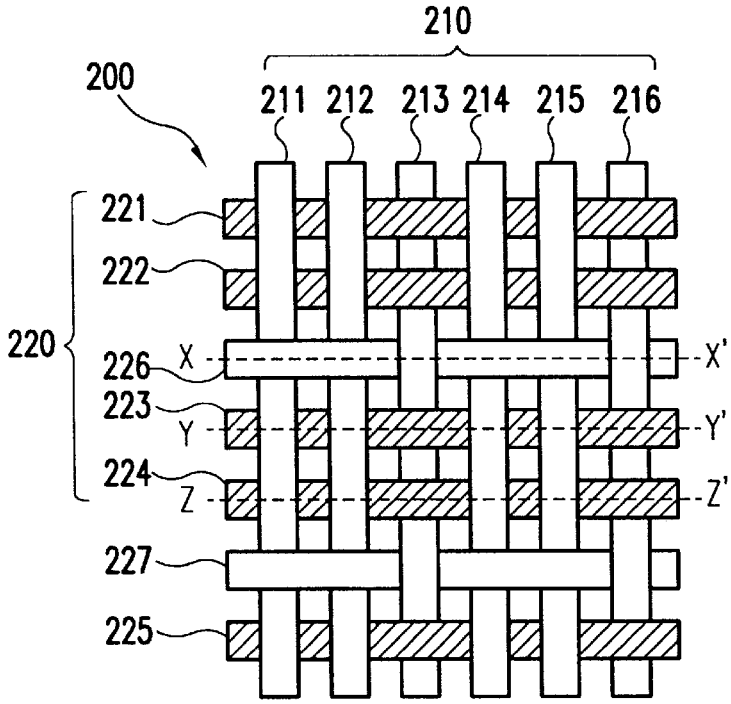
FIG. 3 is a partially enlarged plan view showing the configuration of a second embodiment of the present invention.
Figure 4:
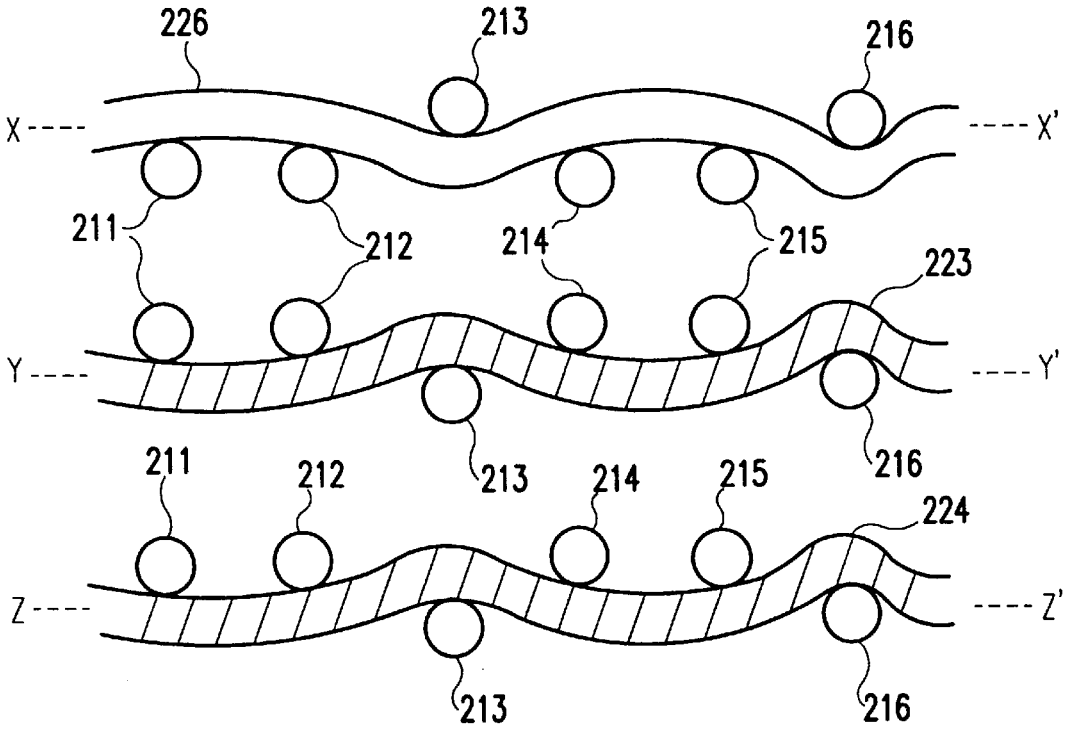
FIG. 4 is a partially enlarged sectional view showing the configuration of the second embodiment of the present invention.

FIG. 3 is a plan view for the describing the configuration of the second embodiment. FIG. 4 is a sectional plan of line X–X', line Y–Y', and line Z–Z' of FIG. 2. As with the previously mentioned drawings, these drawings schematically represent the necessary parts of the material comprising the dust proof clothing in an enlarged view. In FIG. 3, the front is the outside of the dust proof clothing and the rear is the inside of the dust proof clothing. In FIG. 4, the upper part of the drawing is the outside of the dust proof clothing and the lower side of the drawing is the inside of the dust proof clothing.

In the configuration of the second embodiment, dust proof clothing material 200 is constructed so that multiple fiber group 210 extending in the first direction and multiple fiber group 220 extending in the second direction intersecting with the first direction are mutually interwoven.

Here, the first direction means the vertical direction on the drawing and the second direction means the lateral direction, with the second direction being substantially perpendicular to the first direction. The intersection of the fibers on the drawing is perpendicular, but in the actual material would be difficult to say that the fibers are necessarily perpendicular, here, the definition "the first direction" and "the second direction" is used.

Multiple fiber group 210 is constructed from fiber groups 211 through 216. Multiple fiber group 220 is constructed from fiber groups 221 through 227.

Fiber groups 211 through 216 and fiber groups 221 through 226 are each bundled fiber groups of multiple micro fibers. These fiber groups are often called thread.

Fiber groups 211 through 216 are bundled polymers of several linear polyester fibers each with a diameter of 15~20 μm, with each fiber group having a thickness of approximately 50~100 μm in diameter. Here, polyester fibers are used, but as mentioned above, it is also possible to use nylon or fibers of other materials.

Fiber groups 221 through 225 are bundled polymers of curved polyester fibers each with a diameter of 5~10 μm, with each fiber group having a thickness of approximately 50~80 μm in diameter. Here, similarly to the configuration of the first embodiment, polyester fibers are polyester fibers processed in a wave or sinuous state.

It is desirable that the diameters of these fiber groups 221 through 225 are narrower than the diameters of the fiber groups 211 through 216. It can be assumed that the size of each of the fibers and fiber groups will differ according to the material, etc., but the designer will be able to suitably select so that the duality of the vertical direction fiber groups and the lateral direction fiber groups is of the above mentioned relationship.

Fiber group 226 and fiber group 227 are respectively arranged between fiber group 222 and fiber group 223, and between fiber group 224 and fiber group 225. These fiber group 226 and 227, similarly to the aforementioned fiber groups 211 through 216, are bundled polymers of multiple linear polyester fibers each with a diameter of 15~20 μm, and each fiber group has a thickness of approximately 50~100 μm in diameter.

Next, with reference to FIG. 4 showing a cross sectional view of line X–X', line Y–Y', and line Z–Z' in FIG. 3, a specific description will be given of the mutually interwoven structure of the vertical direction fiber groups and the lateral direction fiber groups.

Fiber groups 221 through 225 on the inside of the dust proof clothing extend to the outside of the dust proof clothing crossing two fiber groups 211 and 212. Further, fiber groups 221 through 225 on the outside of the dust proof clothing extend to the inside crossing one fiber group 213. Further, fiber groups 221 through 225 on the inside of the dust proof clothing extend to the outside of the dust proof clothing, crossing two fiber groups 214 and 215.

Fiber groups 226 and 227 on the outside of the dust proof clothing extend to the inside of the dust proof clothing crossing fiber groups 211 and 212. Further, fiber groups 226 and 227 on the inside of the dust proof clothing extend to the outside crossing fiber group 213. Further, fiber groups 226 and 227 on the outside of the dust proof clothing extend to the inside of the dust proof clothing crossing two fiber groups 214 and 215.

Multiple fiber group 210 and multiple fiber group 220 form material 200 of the dust proof clothing by being repeatedly interwoven in the aforementioned pattern.

As can be understood from FIG. 3 and FIG. 4, in cross section X–X' only liner fiber group (211 through 216 and 226) are shown.

In this case, where fiber group 226 appears on the outside and the inside of the dust proof clothing, the separation on the inside is "one (fiber group 226 extending over fiber group 213)", compared to "two (fiber group 226 extending over fiber group 211 and 212)" on the outside. In the case where fiber group 211 through 213 appears on the outside and the inside of the dust proof clothing, the separation on inside is "two (fiber group 211 and 212 extending over fiber group 226)", compared to "one (fiber group 213 extending over fiber group 226)" on the outside.

On the Y–Y' cross section linear fiber group (211 through 216)" and curved fiber group 223 appear.

In this case, where fiber group 223 appears on the outside and the inside of the dust proof clothing, the separation on the inside is "two (fiber group 223 extending over fiber group 211 and 212)", compared to "one (fiber group 223 extending over fiber group 213)" on the outside. In the case where fiber group 211 through 213 appears on the outside and the inside of the dust proof clothing, the separation on the inside is "one (fiber group 213 extending over fiber group 223)", compared to "two (fiber group 211 and 212 extending over fiber group 223)" on the outside.

The Z–Z' cross section is the same as the aforementioned Y–Y' cross section. Therefore, in the case where fiber group 224 appears on the outside and the inside of the dust proof clothing, the separation on the outside is "one" compared to "two" on the inside. In the case where fiber group 211 through 213 appears on the outside and the inside of the dust proof clothing, the separation on the inside is "1" compared to "2" on the outside.

As material 200 of the configuration of the present embodiment is a repetition of the pattern of FIG. 3 and FIG. 4, the ratio of fiber group 210 appearing on the outside to it appearing on the inside of the dust proof clothing is 5 to 4. Also, the ratio of curved fiber groups 221 through 225 and linear fiber groups 226 and 227 appearing on the outside of the dust proof clothing is 2 to 2, and the ratio of curved fiber groups 221 through 225 and linear fiber groups 226 and 227 appearing on the inside of the dust proof clothing is 1 to 4.

In the configuration of this embodiment, compared to the configuration of the first embodiment, the extent to which there are more linear fiber groups exposed to the outside of the dust proof clothing than the curved fiber groups is even greater than in the configuration of the first embodiment, and the extent to which there are more curved fiber groups exposed to the inside of the dust proof clothing than linear fiber groups is even greater than in the configuration of the first embodiment.

In the configuration of this embodiment, similarly to the configuration of the first embodiment, it can be said that as the diameter of the linear fiber groups is larger than that of the curved fiber groups, the large diameter fiber groups are even more exposed to the outside than the in the configuration of the first embodiment, and even more of the small diameter fiber groups are exposed to the inside than in the configuration of the first embodiment. Also, it can be said that even more linear thick thread is exposed to the outside than in the configuration of the first embodiment, and that even more of the curved thin thread is exposed to the inside than in the configuration of the first embodiment.

In the case where dust proof clothing is produced using material constructed in such a way, in addition to the effects of the aforementioned configuration of the first embodiment, the following effects can be expected.

Even more linear fiber groups than curved fiber groups are exposed to the outside of the dust proof clothing than in the configuration of the first embodiment, and even more curved fiber groups than linear fiber groups are exposed to the inside of the dust proof clothing than in the configuration of the first embodiment. Therefore, dust is even more difficult to catch on the outside of the dust proof clothing than on the dust proof clothing of the configuration of the first embodiment, and the caught dust is even further prevented from being released within the clean room. Also, even more dust is caught within the dust proof clothing than the dust proof clothing of the configuration of the first embodiment.

In this way, according to the configuration of the second embodiment of the present invention, dust proof clothing has been realized whereby it is even easier for dust emitted from the wearer to be caught and difficult for outside dust to be caught than the dust proof clothing in the configuration of the first embodiment.

Next, the configuration of the third embodiment of the present invention will be described.

Figure 5:
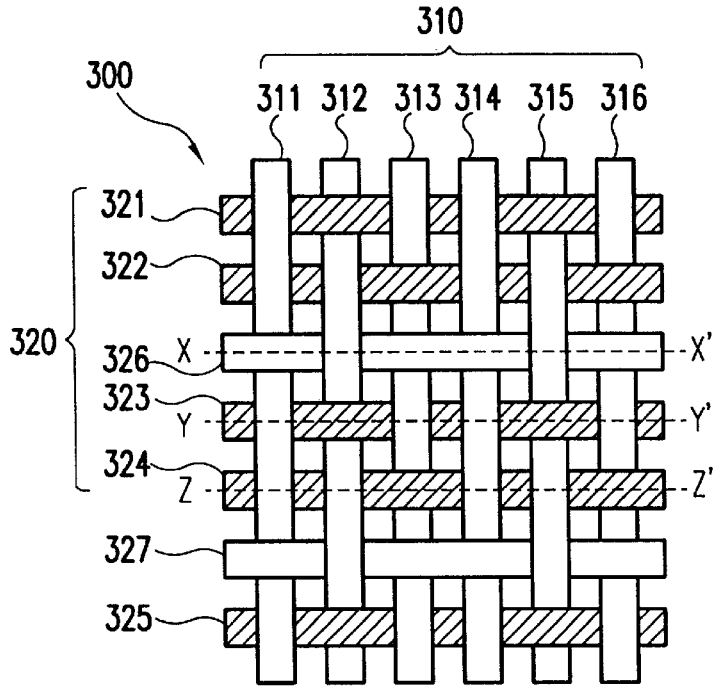
FIG. 5 is a partially enlarged plan view showing the configuration of a third embodiment of the present invention.
Figure 6:
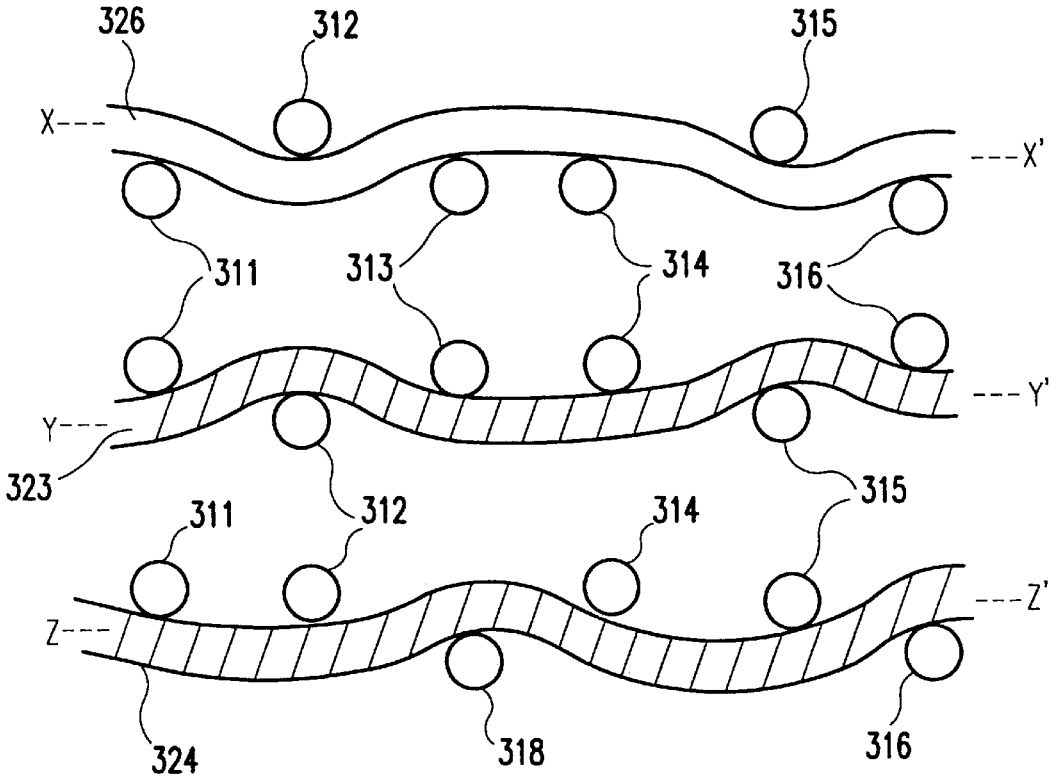
FIG. 6 is a partially enlarged sectional view showing the configuration of the third embodiment of the present invention.

FIG. 5 is a plan view for the describing the configuration of the third embodiment, and FIG. 6 is a sectional drawing describing the configuration of the third embodiment. FIG. 6 is a sectional drawing along the line X–X', line Y–Y', and line Z–Z' of FIG. 5. As with the previously mentioned drawings, these drawings schematically represent the necessary parts of the material comprising the dust proof clothing in an enlarged view. In FIG. 5, the front is the outside of the dust proof clothing and the rear is the inside of the dust proof clothing. In FIG. 6, the upper side of the drawing is the outside of the dust proof clothing and the lower side of the drawing is the inside of the dust proof clothing.

In the configuration of the third embodiment, dust proof clothing material 300 is constructed so that multiple fiber group 310 extending in the first direction and multiple fiber group 320 extending in the second direction intersecting with the first direction are mutually interwoven.

Here, the first direction means the vertical direction on the drawing and the second direction means the lateral direction, with the second direction being substantially perpendicular to direction one. The intersection of the fibers on the drawing is perpendicular, but in the actual material, as it would be difficult to say that the fibers are necessarily perpendicular, here, the definition "the first direction" and "the second direction" is used.

Multiple fiber group 310 is comprised from fiber groups 311 through 316. Multiple fiber group 320 is comprised from fiber groups 321 through 327.

Fiber groups 311 through 316 and fiber groups 321 through 326 are each bundled fiber groups of multiple micro fibers. These fiber groups are often called thread.

Fiber groups 311 through 316 are bundled polymers of several linear polyester fibers each with a diameter of 15~20 $\mu$m, with each fiber group having a thickness of approximately 50~100 $\mu$m in diameter. Here, polyester fibers are used, but as mentioned above, it is also possible to use nylon or fibers of other materials.

Fiber groups 321 through 325 are bundled polymers of curved polyester fibers each with a diameter of 5~10 $\mu$m, with each fiber group having a thickness of approximately 50~80 $\mu$m in diameter. Here the polyester fibers are the same as in the configuration of the second embodiment, polyester fibers processed in a wave or sinuous state.

It is desirable that the diameters of these fiber groups 321 through 325 are narrower than the diameters of the fiber groups 311 through 316. It can be assumed that the size of each of the fibers and fiber groups will differ according to the material, etc., but the designer will be able to suitably select so that the duality of the vertical direction fiber groups and the lateral direction fiber groups is of the above mentioned relationship.

Fiber group 326 and fiber group 327 are respectively arranged, between fiber group 322 and fiber group 323, and between fiber group 324 and fiber group 325. These fiber groups 326 and 327, similarly to the aforementioned fiber groups 311 through 316 are bundled polymers of multiple linear polyester fibers each with a diameter of 15~20 $\mu$m, and each fiber group has a thickness of approximately 50~100 $\mu$m in diameter.

Next, with reference to FIG. 6 showing a cross sectional view along line X–X', line Y–Y', and line Z–Z' in FIG. 5, a specific description will be given of the mutually interwoven structure of the vertical direction fiber groups and the lateral direction fiber groups.

Fiber group 321 on the inside of the dust proof clothing extends to the outside of the dust proof clothing crossing one fiber group 311. Further, fiber group 321 on the outside of the dust proof clothing extends to the inside crossing one fiber group 312. Further, fiber group 321 on the inside of the dust proof clothing extends to the outside of the dust proof clothing, crossing two fiber groups 313 and 314.

Fiber group 322 adjacent to this fiber group 321 on the inside of the dust proof clothing extends to the outside of the dust proof clothing crossing two fiber groups 311 and 312. Further, fiber group 322 on the outside of the dust proof clothing extends to the inside crossing one fiber group 313. Further, fiber group 322 on the inside of the dust proof clothing extends to the outside of the dust proof clothing crossing two fiber groups 314 and 315. Other fiber group pairs (323 and 324, and 325 and the fiber group adjacent to 325 (not shown in the drawings)) are arranged having same relationship as the relationship between the pair of fiber groups 321 and 322, and the fiber groups 311 through 316.

Fiber groups 326 and 327 on the outside of the dust proof clothing extend inside the dust proof clothing crossing one fiber group 311. Further, fiber groups 326 and 327 on the inside of the dust proof clothing extend outwards crossing one fiber group 312. Further fiber groups 326 and 327 on the outside of the dust proof clothing extend inwards crossing two fiber groups 313 and 314.

Multiple fiber group 310 and multiple fiber group 320 form material 200 of the dust proof clothing by being repeatedly interwoven in the aforementioned pattern.

As can be understood from FIG. 5 and FIG. 6, in cross section X–X' only liner fiber groups (311 through 316 and 326) are shown.

In this case, where fiber group 326 appears on the outside and the inside of the dust proof clothing, the separation on inside is "one (fiber group 326 extending over fiber group 312)", compared to "two (fiber group 326 extending over fiber group 313 and 314)" on the outside. In the case where fiber group 311 through 316 appears on the outside and the inside of the dust proof clothing, the separation on inside is "2 (fiber group 313 and 314 extending over fiber group 326)", compared to "one (fiber group 312 extending over fiber group 326)" on the outside.

On the Y–Y' cross section linear fiber group (311 through 316)" and curved fiber group 323 appear.

In this case, where fiber group 323 appears on the outside and the inside of the dust proof clothing, the separation on inside is "two (fiber group 323 extending over fiber group 313 and 314)", compared to "one (fiber group 323 extending over fiber group 312)" on the outside. In the case where fiber group 311 through 316 appears on the outside and the inside of the dust proof clothing, the separation on the inside is "one (fiber group 312 extending over fiber group 323)", compared to "two (fiber group 313 and 314 extending over fiber group 323)" on the outside.

The Z–Z' cross section is the same as the aforementioned Y–Y' cross section with the fiber groups shifted one column in a lateral direction. Therefore, in the case where fiber group 324 appears on the outside and the inside of the dust proof clothing, the separation on the inside is "two" compared to "one on the outside. In the case where fiber group 311 through 316 appears on the outside and the inside of the dust proof clothing, the separation on the inside is "one" compared to "two" on the outside.

As material 300 of the configuration of the present embodiment is a repetition of the pattern of FIG. 5 and FIG. 6, the ratio of fiber groups 310 appearing on the outside to them appearing on the inside of the dust proof clothing is 5 to 4. Also, the ratio of curved fiber groups 321 through 325 to linear fiber groups 326 and 327 appearing on the outside of the dust proof clothing is 2 to 2, and the ratio of curved fiber groups 321 through 325 to linear fiber groups 326 and 327 appearing on the inside of the dust proof clothing is 1 to 4.

In the configuration of this embodiment, compared to the configuration of the first embodiment, even more of the linear fiber groups are exposed to the outside of the dust proof clothing than the curved fiber groups in the configuration of the first embodiment, and even more curved fiber groups are exposed to the inside of the dust proof clothing than the linear fiber groups in the configuration of the first embodiment.

In the configuration of this embodiment, similarly to the configuration of the first embodiment, it can be said that as the diameter of the linear fiber groups is larger than that of the curved fiber groups, the large diameter fiber groups are even more exposed to the outside than in the configuration of the first embodiment, and even more of the small diameter fiber groups are exposed to the inside than in the configuration of the first embodiment. Also, it can be said that even more linear thick thread is exposed to the outside than in the configuration of the first embodiment, and that even more of the curved thin thread is exposed to the inside than in the configuration of the first embodiment.

In the case where dust proof clothing is produced using material comprised in such a way, in addition to the effects of the aforementioned configuration of the first embodiment, the following effects can be expected.

Even more linear fiber groups than curved fiber groups are exposed to the outside of the dust proof clothing than in the configuration of the first embodiment, and even more curved fiber groups than linear fiber groups are exposed to the inside of the dust proof clothing than in the configuration of the first embodiment. Therefore, it is even more difficult for dust to be caught on the outside of the dust proof clothing than on the dust proof clothing of the configuration of the first embodiment, and the caught dust is even further prevented from being released within the clean room. Also, even more dust is trapped within the dust proof clothing than the dust proof clothing of the configuration of the first embodiment.

In this way, according to the configuration of the third embodiment of the present invention, dust proof clothing has been realized whereby it is even easier for dust emitted from the wearer to be caught and difficult for outside dust to be caught than the dust proof clothing in the configuration of the first embodiment.

As mentioned above, according to the present invention, dust proof clothing is provided wherein there are fewer dust catching spaces on the outside surface of the dust proof clothing compared to the inside surface, and as there are more dust catching spaces on the inside surface compared to the outside surface, more dust is caught on the inside of the dust proof clothing which comes in contact with the wearer, and on the outside of the dust proof clothing dust does not attach easily and it has superior strength.

The present invention applies to dust proof clothing worn inside clean rooms where it is necessary to control various dust from the perspective of quality and hygiene, particularly dust proof clothing worn in clean rooms in the semiconductor field, precision device field, medical and pharmaceutical field and food processing field.

Figure 7:
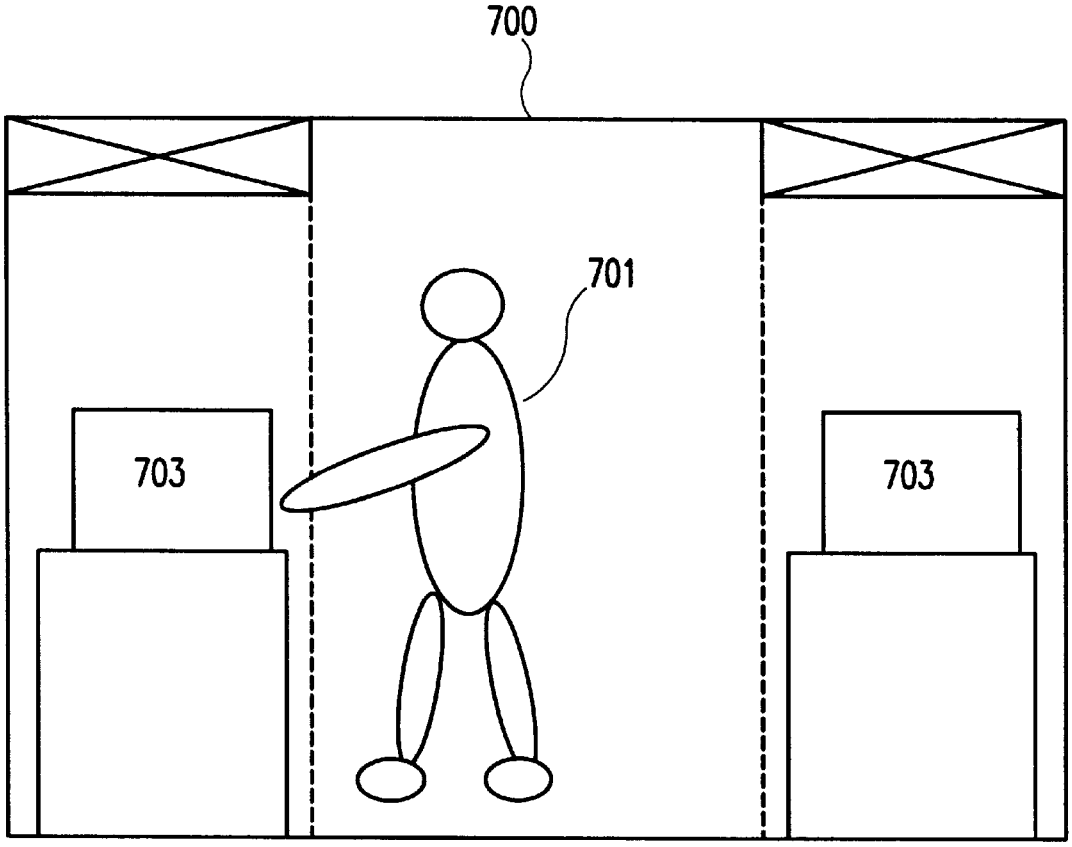
FIG. 7 is a partially enlarged sectional view of a clean room.

For example, in clean room 700 of the semiconductor field as shown in FIG. 7, an operator 701 is engaged in an operation wearing the above mentioned dust proof clothing. The operator 701 is handling semiconductor wafers on the inside of or surrounding semiconductor processing device 702 and 703. Also, the operator 701 is controlling devices 702 and 703.

In this kind of place, the effect of dust over a certain level is extremely significant. Due to the presence of dust, the situation can be envisaged where the minute pattern scheduled to be formed on the semiconductor wafer can not be formed according to plan. This means an increase in defective units, that is to say, a reduction in the yield percentage (the ratio of obtained non-defective items). Also, from the perspective of product reliability, it is desirable to make every effort to remove dust which brings about unpredictable events.

By the above mentioned configuration of the embodiment, a single layer material interwoven from a vertical direction fiber group and a lateral direction fiber group is shown. However, it is also possible to apply the present invention to a material with a multi-layer structure. For example, it can also be applied to a multi layered construction, whereby the inside surface of the dust proof clothing is formed from only the above mentioned curved fibers, and the outside surface is formed from only the above mentioned straight fibers, and the inside surface and the outside surface are clad together. In this case, either the single layer construction or the multi-layer construction will be adopted with consideration given to ease of movement when worn, ventilation, comfort and cost, etc.

According to the present invention, it is possible to provide dust proof clothing whereby, as the outside surface has fewer dust catching spaces compared to the inside surface, and the inside surface has more dust catching spaces compared to the outside surface, a lot of dust is caught on the inside of the dust proof clothing in contact with the wearer and dust has difficulty in adhering to the outside of the dust proof clothing, and which also has superior strength.

The present invention has been described using illustrative embodiments, but this description must not be interpreted in a limited sense. Various changes in these illustrative embodiments of the present invention will, with reference to this description, be clear to one skilled in the art Therefore, it is considered that the scope of the patent application covers all such changes and embodiments included in the true scope of the present invention.

What is claimed is:

1. In a method for handling semiconductor wafers in a clean room, the improvement comprising;

providing dust proof clothing made of a given fabric structure defined by multiple first fiber groups which are each composed of linear fibers and extend in a first direction, and multiple second fiber groups which are each composed of curved fibers and extend in a second direction intersecting said first direction, wherein said first and second fiber groups are mutually interwoven, wherein an inside surface of said clothing has more of said second fiber groups exposed than said first fiber groups, and wherein an outside surface which is opposite said inside surface has more of said first fiber groups exposed than said second fiber groups; and wearing said dust proof clothing with said fabric structure such that said inside surface is in contact with a wearer of said dust proof clothing.

2. In a method as claimed in claim 1, further comprising providing said dust proof clothing with said fabric structure that is further defined by multiple third fiber groups which are composed of linear fibers, and which are respectively arranged between said multiple second fiber groups, and which extend in said second direction;

wherein each of said second fiber groups on said outside surface crosses one of said first fiber groups and then extends to said inside surface;

wherein each of said second fiber groups on said inside surface crosses two of said first fiber groups and then extends to said outside surface;

wherein each of said third fiber groups on said outside surface crosses two of said first fiber groups and then extends to said inside surface; and wherein each of said third fiber groups on said inside surface crosses one of said first fiber groups and then extends to said outside surface.

3. In a method as claimed in claim 1, further comprising providing said dust proof clothing with said fabric structure that is further defined by said multiple second fiber groups being arranged as fiber group pairs which are each comprised of two adjacent second fiber groups, and by multiple third fiber groups which are each composed of linear fibers, and which are respectively arranged between adjacent fiber group pairs, and which extend in said second direction, wherein each of said fiber group pairs on said outside surface crosses one of said first fiber groups and then extends to said inside surface;

wherein each of said fiber group pairs on said inside surface crosses two of said first fiber groups and then extends to said outside surface, wherein each of said third fiber groups on said outside surface crosses two of said first fiber groups and then extends to said inside surface; and wherein each of said third fiber groups on said inside surface crosses one of said first fiber groups and then extends to said outside surface.

4. In a method as claimed in claim 1, further comprising providing said dust proof clothing with said fabric structure that is further defined by said multiple second fiber groups being arranged as fiber group pairs which are each comprised of two adjacent second fiber groups, and by multiple third fiber groups which are each composed of linear fibers, and which are respectively arranged between adjacent fiber group pairs, and which extend in said second direction, wherein respective ones of said second fiber groups of each of said fiber group pairs cross each of said first fiber groups on opposite ones of said inside surface and said outside surface, wherein each of said third fiber groups on said outside surface crosses two of said first fiber groups and then extends to said inside surface; and wherein each of said third fiber groups on said inside surface crosses one of said first fiber groups and then extends to said outside surface.

5. In a method as claimed in claim 1, further comprising providing said dust proof clothing with said fabric structure that is further defined by a diameter of each of said first fiber groups being larger than a diameter of each of said second fiber groups.

6. In a method as claimed in claim 1, further comprising providing said dust proof clothing with said fabric structure that is further defined by a diameter of each of said first fiber groups being from $50\mu$ to $100\mu$, and a diameter of each of said second fiber groups being from $50\mu$ to $80\mu$.

* * * * *